US009327331B2

(12) United States Patent
Golovashchenko et al.

(10) Patent No.: US 9,327,331 B2
(45) Date of Patent: May 3, 2016

(54) HEMMING A FLANGE WITH COMPRESSION TO FORM A SHARP EDGE

(71) Applicant: Ford Global Technologies, LLC, Dearborn, MI (US)

(72) Inventors: Sergey Fedorovich Golovashchenko, Beverly Hills, MI (US); Alan John Gillard, Dearborn, MI (US); Chatchai Wanintradul, Madison Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/529,232

(22) Filed: Oct. 31, 2014

(65) Prior Publication Data

US 2015/0047409 A1 Feb. 19, 2015

Related U.S. Application Data

(62) Division of application No. 13/276,784, filed on Oct. 19, 2011, now Pat. No. 8,875,554.

(51) Int. Cl.

| | |
|---|---|
| ***B21D 19/08*** | (2006.01) |
| ***B21D 11/22*** | (2006.01) |
| ***B21D 39/02*** | (2006.01) |

(52) U.S. Cl.

CPC ..... *B21D 19/08* (2013.01); *B21D 11/22* (2013.01); *B21D 39/02* (2013.01)

(58) Field of Classification Search

CPC ..... B21D 39/02; B21D 39/021; B21D 11/22; B21D 19/08

See application file for complete search history.

(56) References Cited

U.S. PATENT DOCUMENTS

| | | | | |
|---|---|---|---|---|
| 5,086,638 | A | 2/1992 | David | |
| 5,991,993 | A | 11/1999 | Knudson | |
| 6,257,043 | B1 * | 7/2001 | Wiens | B21D 39/021 29/243.58 |
| 6,314,783 | B1 * | 11/2001 | Patrick | B21D 39/021 29/243.58 |
| 6,487,888 | B1 * | 12/2002 | Baulier | B21D 39/021 100/269.02 |
| 6,584,661 | B2 | 7/2003 | Suzuki et al. | |

(Continued)

FOREIGN PATENT DOCUMENTS

| | | |
|---|---|---|
| JP | 2151582 | 6/1990 |
| JP | 3221215 | 9/1991 |

(Continued)

OTHER PUBLICATIONS

Muderrisoglu, et al., Bienrevue, REFdoc.fr, CNRS, INIST, Bending, flanging, and hemming of aluminum sheet—an experimental study, Department of Mechanical Engineering, Ohio State University, Columbus, Ohio 43210, 1996, vol. 59, No. 1-2, pp. 10-17.

(Continued)

*Primary Examiner* — Teresa M Ekiert

(74) *Attorney, Agent, or Firm* — Damian Porcari; Brooks Kushman P.C.

(57) ABSTRACT

A tool and method of hemming a panel wherein the tool engages a flange to apply a compressive force with a stop initially preventing a distal end of the flange from moving inwardly. The hemming tool bends the intermediate portion of the flange between the flange bend and the distal end toward the panel. The stop is withdrawn to allow the flange to be progressively formed toward the panel until the distal end is aligned with the intermediate portion.

13 Claims, 8 Drawing Sheets

(56) References Cited

U.S. PATENT DOCUMENTS

| | | | | |
|---|---|---|---|---|
| 6,739,169 | B2 | 5/2004 | Baulier | |
| 6,865,917 | B2 | 3/2005 | Golovashchenko et al. | |
| 7,007,368 | B2 | 3/2006 | Sovoda | |
| 7,082,803 | B2 * | 8/2006 | Hario | B21D 39/021 29/243.58 |
| 7,770,955 | B2 | 8/2010 | Kleber et al. | |
| 2003/0192362 | A1 | 10/2003 | Carsley et al. | |
| 2004/0206149 | A1 | 10/2004 | Hario et al. | |
| 2008/0250835 | A1 | 10/2008 | Hasegawa et al. | |
| 2010/0281940 | A1 | 11/2010 | Harrow et al. | |

FOREIGN PATENT DOCUMENTS

| | | |
|---|---|---|
| JP | 6344038 | 12/1994 |
| JP | 2006344038 | 12/1994 |

OTHER PUBLICATIONS

Altan, T. et al., Improvement of hem quality by optimizing flanging and pre-hemming operations using computer aided die design, MCSA, ILLUMINA, Welcome to ProQuest-CSA, your Guide to Discovery, Journal of Materials Processing Technology (Netherlands), vol. 98, No. 1, pp. 41-52. Jan. 15, 2000.

* cited by examiner

HEMMING A FLANGE WITH COMPRESSION TO FORM A SHARP EDGE

CROSS-REFERENCE TO RELATED APPLICATIONS

This application is a division of U.S. application Ser. No. 13/276,784 filed Oct. 19, 2011, the disclosure of which is hereby incorporated in its entirety by reference herein.

TECHNICAL FIELD

This disclosure relates to flanging and hemming sheet metal panels that have sharp edges.

BACKGROUND

Flanging and hemming processes for sheet metal parts formed of aluminum alloys and AHSS have been under development for more than a decade. One problem is caused by the reduced ability of aluminum alloys and AHSS to bend around sharp radius.

Several techniques have been proposed to address this problem. For example U.S. Pat. No. 6,257,043 discloses a press hemming process in which the hemming area is compressed while forming the hem. This process was further developed as roll hemming process in U.S. Pat. No. 6,810,707. In the roll hemming process, the local pressure applied to the blank is better controlled than in press hemming process. However, the roll hemming process is substantially slower and is only feasible for low volume or mid-volume applications. Several rolls are required on a hemming tool to provide high volume production. Further development of roll hemming technology is disclosed in U.S. Pat. No. 7,347,072. that proposes making three passes of a hemming roller to form the hem. An alternative technique is disclosed in U.S. Pat. No. 6,928,848 in which the main emphasis is to form a sharp flanging radius during the flanging process by controlling the inner radius of the die instead of the displacement of the punch as proposed in the previously mentioned patents.

One problem not addressed by the above patents is creep of the outer panel during later hemming steps. The "creep" phenomenon occurs due to continued bending of the flange during hemming process. The flanging radius undergoes changes during hemming process that result is a loss of sharpness in the flange after hemming. The continued deformation of the area of flange during following hemming process is caused by the movement of flanged material from outer side of the flange towards inner area of the hem that changes the overall radius of the hem and also adds strain to the previously formed flange area.

This disclosure is directed toward solving the above identified problems and other problems that will be apparent to one of ordinary skill in the art as summarized below.

SUMMARY

The disclosed embodiments are directed towards providing a press hemming process and tools that provide sharp hems and also increase productivity compared to the roll hemming processes.

In one disclosed embodiment, a flange is formed on a panel that extends inwardly from the flange bend on the panel at an angle to a distal end of the flange. The panel is placed in a hemming tool that includes a stop that initially engages the distal end of the flange. The panel may be an outer panel and an inner panel may be placed on the outer panel inboard of the flange. The hemming tool engages the flange to apply a compressive force with the stop initially preventing the distal end of the flange from moving inwardly. The hemming tool bends the intermediate portion of the flange between the flange bend and the distal end toward the panel. The stop is then moved inwardly or otherwise withdrawn to allow the flange to be progressively formed toward the panel until the distal end is aligned with the intermediate portion.

According to one aspect of the disclosure, a tool is provided for forming a hem on a panel. The tool comprises a first hem die defining a cavity having a perimeter edge. The panel has a flange at an outer edge at a base of the flange. A second hem die engages a distal end of the flange to compress the flange through the length of the flange into the perimeter edge while forming a hem bend on the flange.

According to additional aspects of the disclosure as it relates to the tool, a stop is provided on the second hem die that initially engages the flange and prevents the flange from moving inwardly while the second hem die moves towards the first hem die. The stop may be a block that moves inwardly as the second hem die moves inwardly. The block may have a face that extends parallel to the direction that the second hem die moves.

The second hem die may have an inner portion and an outer portion that move independently toward the first hem die, wherein the outer portion initially engages the distal edge of the flange, and wherein the inner portion includes the stop that prevents the flange from moving inwardly as the outer portion bends an intermediate portion of the flange inwardly of the distal edge. The outer portion may clamp the intermediate portion of the flange while the inner portion forms the distal edge inwardly and into alignment with the intermediate portion of the flange.

The stop may be a block that has an inwardly angled surface and the block may be refracted into the second hem die as the second hem die moves toward the first hem die. The second hem die may have an inner portion and an outer portion with the stop being provided on the outer portion, and wherein the inner portion advances towards the first hem die while the outer portion remains stationary relative to the first hem die. The inner portion may have a plurality of inner portion ribs separated by a plurality of inner portion grooves, and the outer portion may have a plurality of outer portion ribs that are received in the inner portion grooves and a plurality of outer portion grooves that receive the inner portion ribs to guide the movement of the inner portion relative to the outer portion.

According to another aspect of the disclosure, a method of forming a hem on a sheet metal panel comprises placing the panel in a first part of hemming tool, wherein the panel has a flange that extends inwardly from a body portion of the panel. A second part of the hemming tool advances toward the first part and engaging a distal end of the flange with a stop that prevents the distal end of the flange from moving inwardly and compressing the flange, wherein an intermediate portion of the flange between the body portion and the distal end is formed inwardly. The stop disengages the distal end of the flange after a first portion of the flange is formed to extend parallel to the body. A second portion of the flange that is contiguous with the distal end of the flange is formed to extend parallel to the panel after the first portion of the flange is formed.

According to other aspects of the method, the intermediate portion of the flange may be formed into a concave cross-section in the outwardly facing direction as the intermediate portion is formed inwardly in the advancing step. The stop may be moved inwardly as the second part of the hemming tool moves inwardly. The second part of the hemming tool may include an inner portion and an outer portion that move independently, wherein the inner portion includes the stop, and wherein during the advancing step the stop prevents the distal edge of the flange from moving inwardly as the outer portion bends an intermediate portion of the flange inwardly of the distal edge. The outer portion may clamp the intermediate portion of the flange while the inner portion forms the distal edge inwardly and into alignment with the intermediate portion of the flange.

According to other aspects of the method, the stop may be a block that has an inwardly angled surface, wherein the block is retracted into the second part of the hemming tool as the second part of the hemming tool moves toward the first part of the hemming tool. The second part of the hemming tool may have an inner portion and an outer portion with the stop being provided on the outer portion, and wherein the inner portion advances towards the first part of the hemming tool while the outer portion remains stationary relative to the first part of the hemming tool.

The inner portion may have a plurality of inner portion ribs separated by a plurality of inner portion grooves. The outer portion may have a plurality of outer portion ribs that are received in the inner portion grooves and a plurality of outer portion grooves that receive the inner portion ribs. The method may further comprise guiding the movement of the inner portion relative to the outer portion with the respective ribs and grooves being received in each other.

Other aspects of the disclosure will be more fully described with reference to the attached drawings and the following detailed description of the disclosed embodiments.

DETAILED DESCRIPTION

Figure 1:
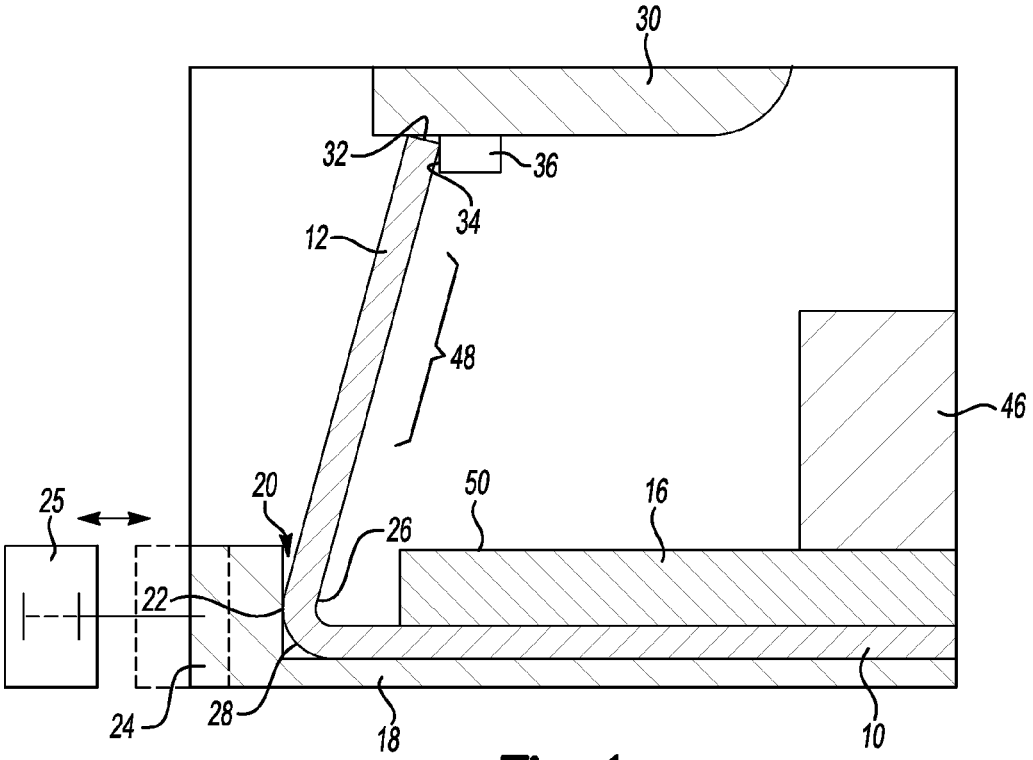
FIG. 1 is a diagrammatic cross-sectional view of a first embodiment of a tool for hemming a flange with compression to form a sharp edge at the beginning of the hemming process.

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Referring to FIGS. 1-4, a panel 10 is shown with a flange 12 that is to be formed over an inner panel 16 to form a hem. The panel 10 is disposed in a first part of a hemming tool 18 that also may be referred to as a first hem die. The first part of the hemming tool defines a cavity 20 that includes a perimeter edge 22. The perimeter edge 22 may be on a movable side support structure 24 that may be moved by a cylinder 25, or the like.

Figure 2:
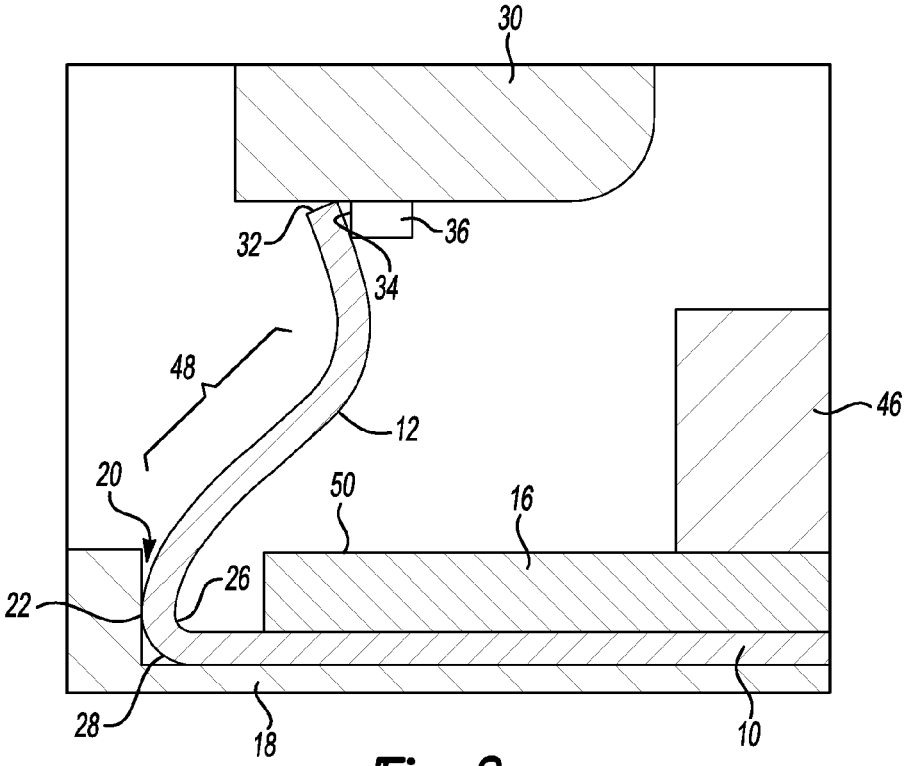
FIG. 2 is a diagrammatic cross-sectional view of the embodiment shown in FIG. 1 in an early intermediate point in the process.
Figure 3:
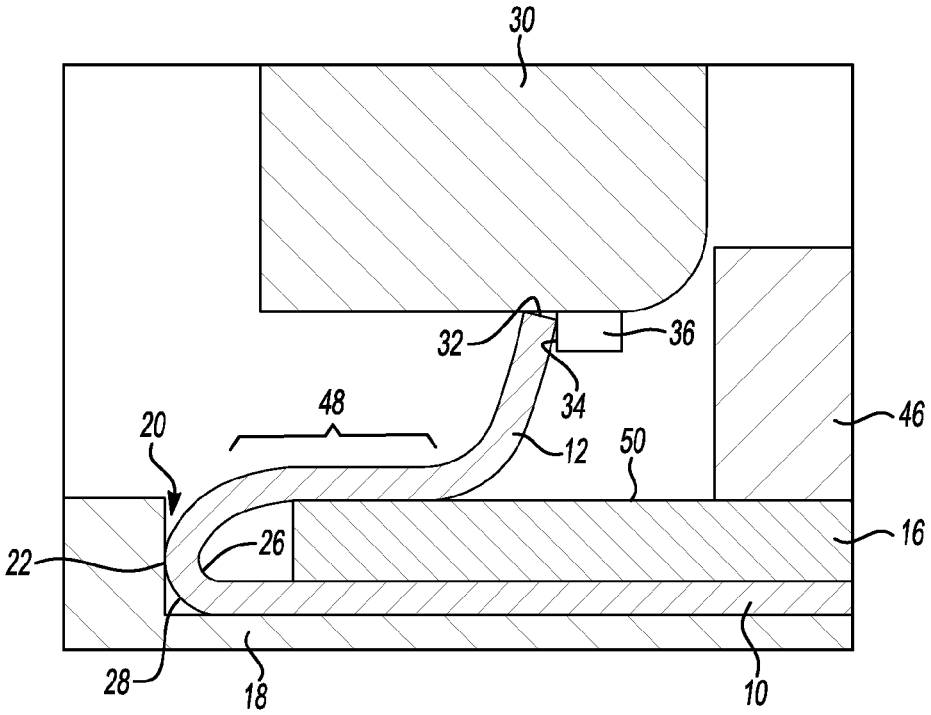
FIG. 3 is a diagrammatic cross-sectional view of the embodiment of FIG. 1 at a late intermediate point in the forming process.
Figure 4:
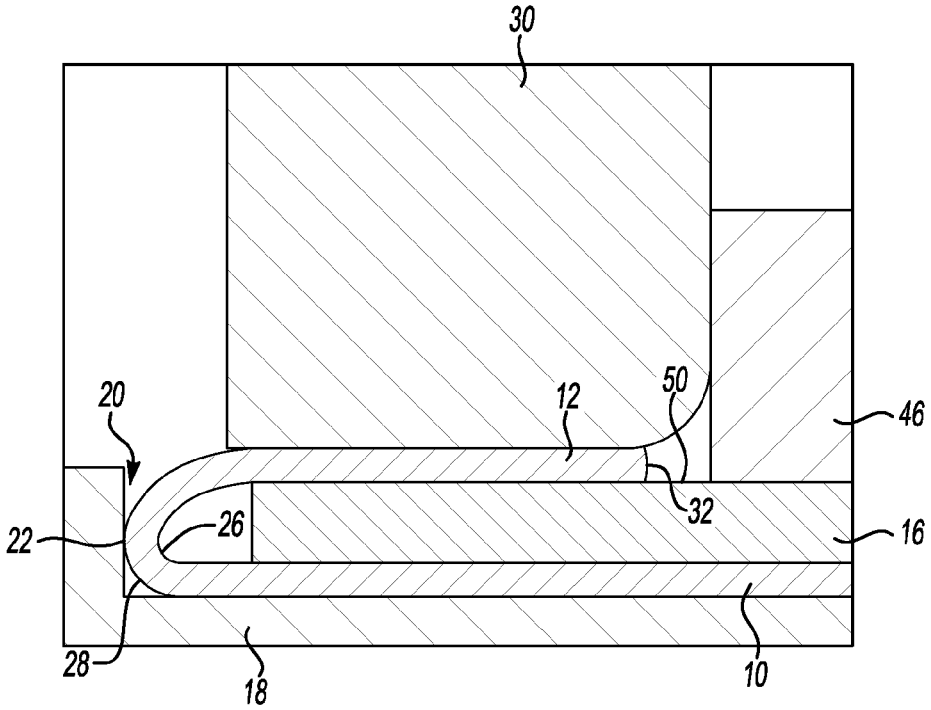
FIG. 4 is a diagrammatic cross-sectional view of the embodiment of FIG. 1 with the tool in its final position.
Figure 5:
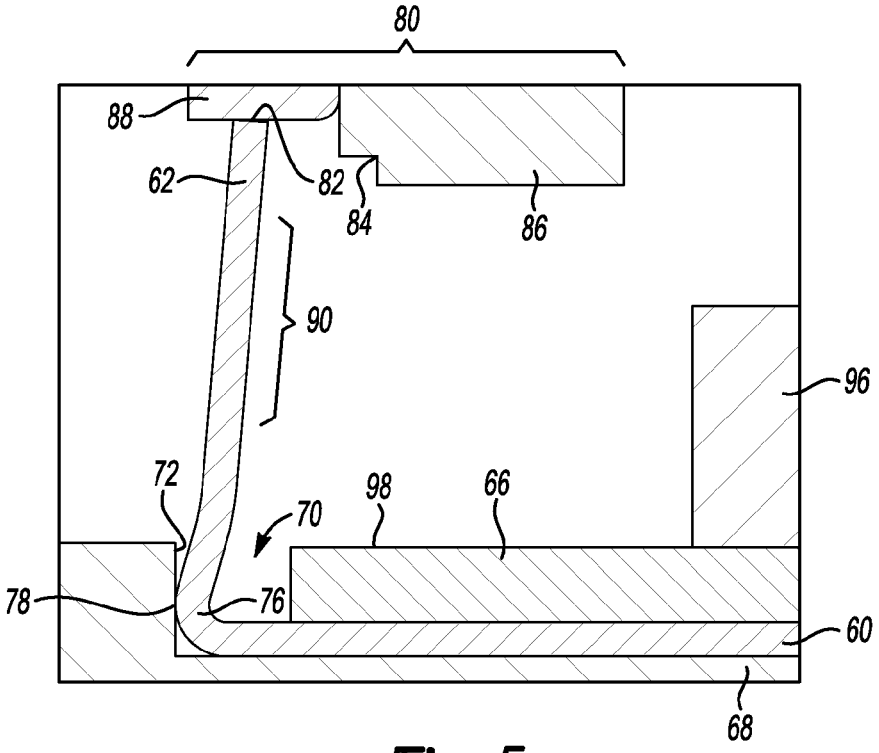
FIG. 5 is a diagrammatic cross-sectional view of a second embodiment of a tool for hemming a flange with compression to form a sharp edge shown in its initial engagement position.

A base 26 of the flange 12 is formed at an outer edge 28 of the panel 10. A second part of the hemming tool 30, which may also be referred to as a second hem tool, is disposed above the first part of the hemming tool 18. A distal end 32 of the flange 12 is engaged by the second part of the hemming tool 30 that exerts a compressive force through the length of the flange 12. The distal end 32 engages a face 34 of a stop 36 that is provided on the second part of the hemming tool 30. A clamping member 46 holds the inner panel 16 against the panel 10 during the hemming process. An intermediate portion 48 of the flange 12 bends to form an outwardly concave surface, as shown in FIGS. 2 and 3, as a result of the compressive force exerted by the second part of the hemming tool 30 on the flange 12. The intermediate portion 48 is formed to fold over and engage an upper surface 50 of the inner panel 16. The distal end 32 of the flange 12 is prevented from moving inwardly by the stop 36, as shown in FIG. 1. In FIG. 2, the intermediate portion 48 has been formed inwardly while the distal end 32 is prevented from moving inwardly by the stop 36. In FIG. 3, the stop, which is maintained in the track (not shown) in the second part of the hemming tool 30, moves inwardly after the intermediate portion 48 is formed into the convex shape to allow the flange 12 to be formed into a parallel orientation relative to the upper surface 50 of the inner panel 16.

The compressive force applied through the flange 12 keeps the outer edge 28 of the panel 10 in firm engagement with the perimeter edge 22 of the cavity 20. By maintaining the compression in flange 12 as it is hemmed over the inner panel 16, the outer edge 28 of the panel 10 maintains a sharp edge on the panel 10 and prevents the flange 12 from creeping inwardly as a result of the hemming operation.

Figure 6:
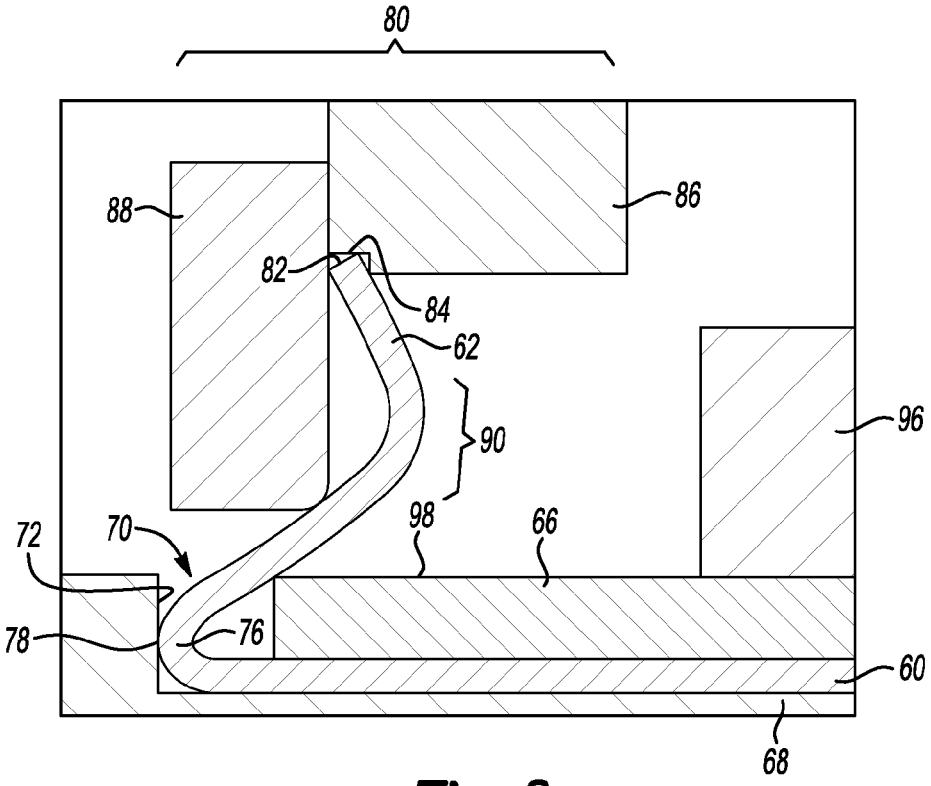
FIG. 6 is a diagrammatic cross-sectional view of the embodiment shown in FIG. 5 in an early intermediate stage in the forming process.
Figure 7:
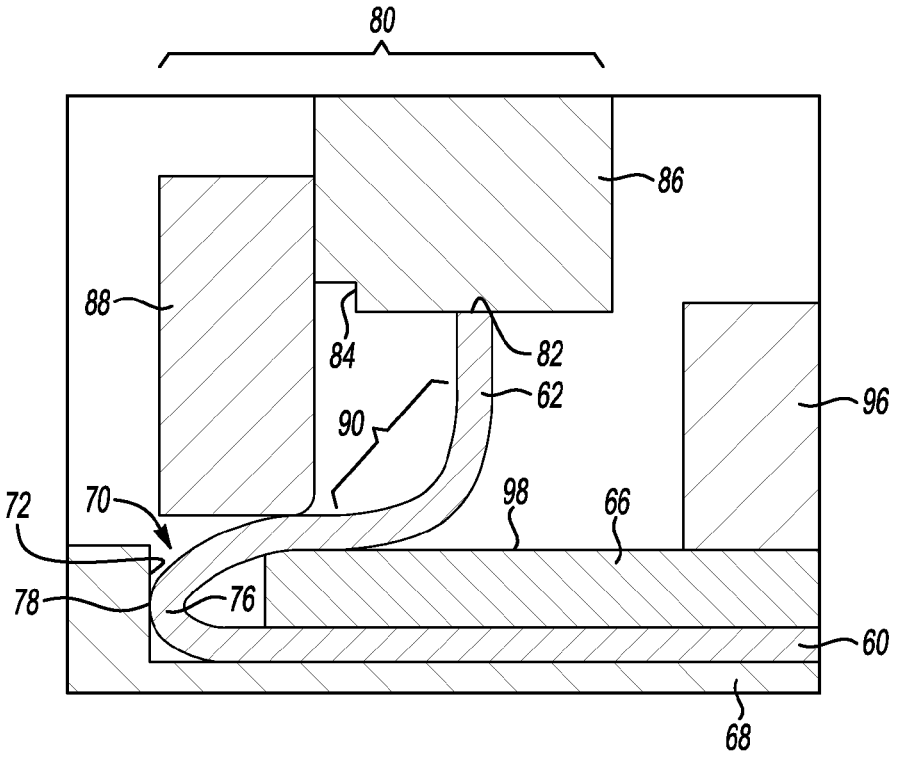
FIG. 7 is a diagrammatic cross-sectional view of the embodiment of FIG. 5 shown in a late intermediate step in the forming process.
Figure 8:
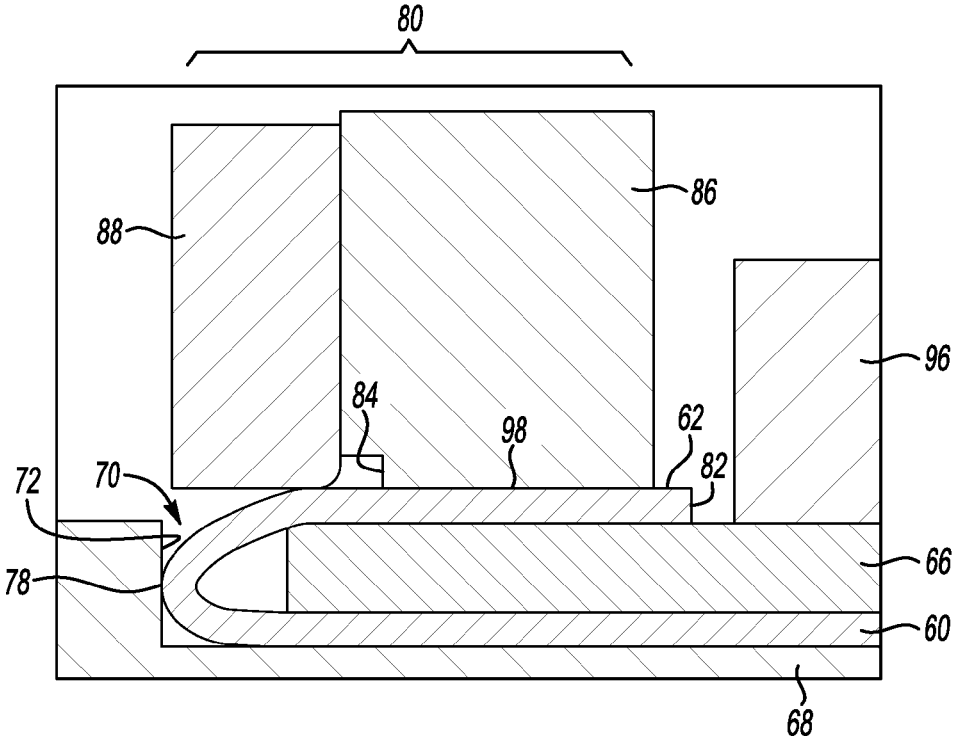
FIG. 8 is a diagrammatic cross-sectional view of the embodiment shown in FIG. 5 at the final point in the hem forming process.
Figure 9:
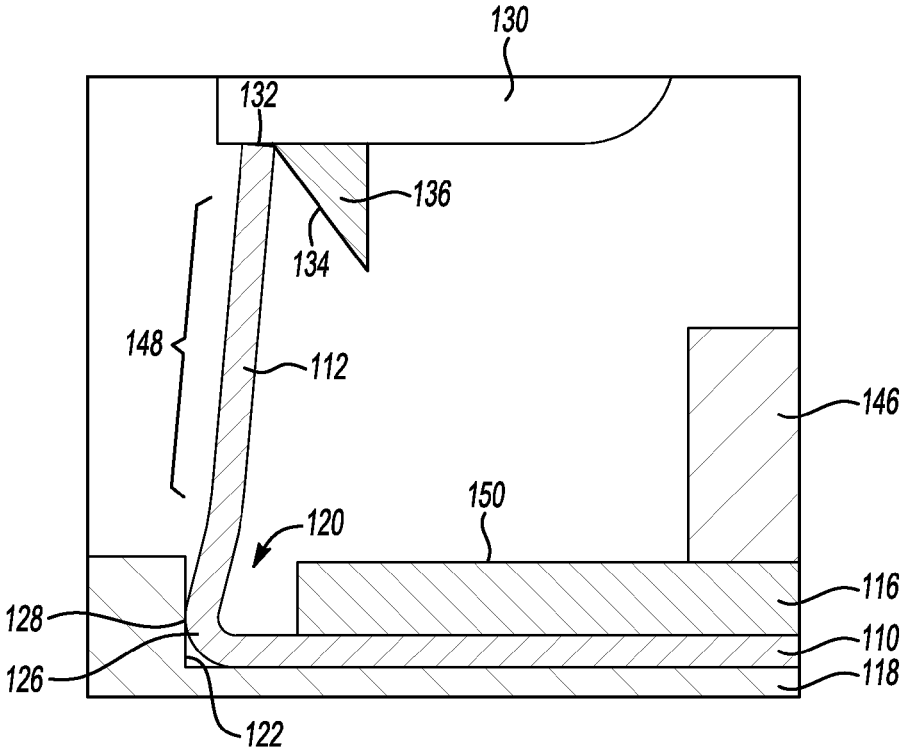
FIG. 9 is a diagrammatic cross-sectional view of a third embodiment of a tool for hemming a flange with compression to form a sharp edge shown in the initial contact position.

Referring to FIGS. 5-8, a panel 60, including a flange 62, is shown as the flange 62 is formed over an inner panel 66 to form a hem. The hem is fully formed, as shown in FIG. 8. A first hem die 68, or first part of a hemming tool, defines a cavity 70 that includes a perimeter edge 72. A base 76 of the flange 62 is formed at an outer edge 78 of the panel 60. A second hem tool 80, or second part of a hemming tool, engages the distal end 82 of the flange 62. As shown in FIG. 6, a notch 84 is provided that receives the distal end 82 of the flange 62, as shown in FIG. 6. The notch 84 prevents the distal end 82 of the flange 62 from moving outwardly as the intermediate portion 90 is formed inwardly by the downward movement of the outer portion 88 of the second hem tool 80. The outer portion 88 bends the flange 62 until it contacts the inner panel 66 at which point the distal end 82 slips from the notch 84. The process continues with the inner portion 86 of the second hem tool 80 continuing to fold the flange inwardly against the inner panel 66 until the flange is fully seated against the upper surface 98 of the inner panel 66. Clamping member 96 holds the inner panel 66 against the panel 60 throughout the forming process. As shown in FIG. 8, the flange 62 is formed fully into engagement with the upper surface 98 of the inner panel 66.

Referring to FIGS. 9-16, a panel 110 includes a flange 112 that is intended to be hemmed over an inner panel 116. The panel 110 and inner panel 116 are loaded into a first hemming die 118, or first part of a hemming tool, that defines a cavity 120. The cavity 120 defines a perimeter edge 122. A base 126 of the flange 112 is provided at an outer edge 128 of the panel 110.

A second hem tool 130, or second part of a hemming tool, engages a distal end 132 of the flange 112. An inwardly angled surface 134 of a stop 136 engages the distal end 132 of the flange 112. The stop 136 prevents the distal end 132 of the flange 112 from moving inwardly until initially as the flange 112 is hemmed over the inner panel 116. The inner panel 116 is held in place relative to the panel 110 by a clamping member 146.

Figure 10:
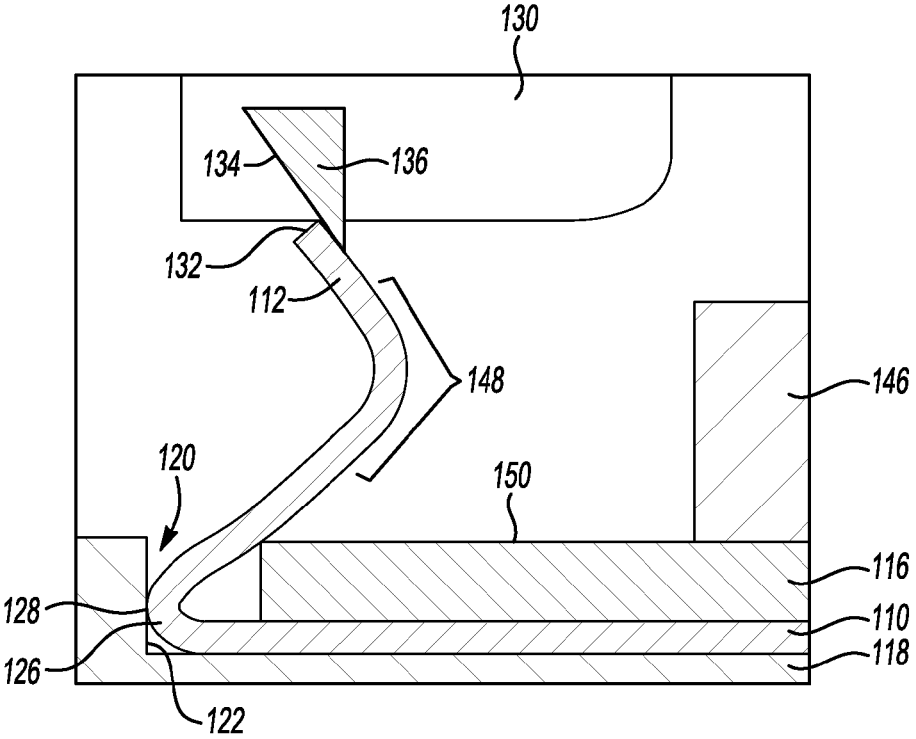
FIG. 10 is a diagrammatic cross-sectional view of the embodiment of FIG. 9 shown in an early intermediate stage of the process.
Figure 11:
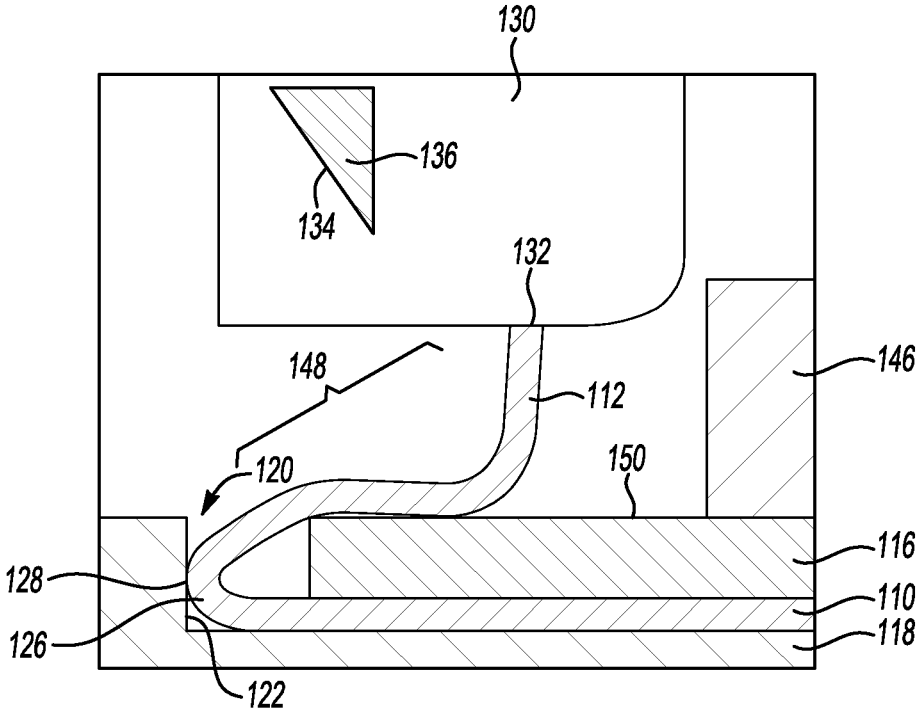
FIG. 11 is a diagrammatic cross-sectional view of the embodiment of the tool shown in FIG. 9 at a late intermediate point in the process of forming the hem.
Figure 12:
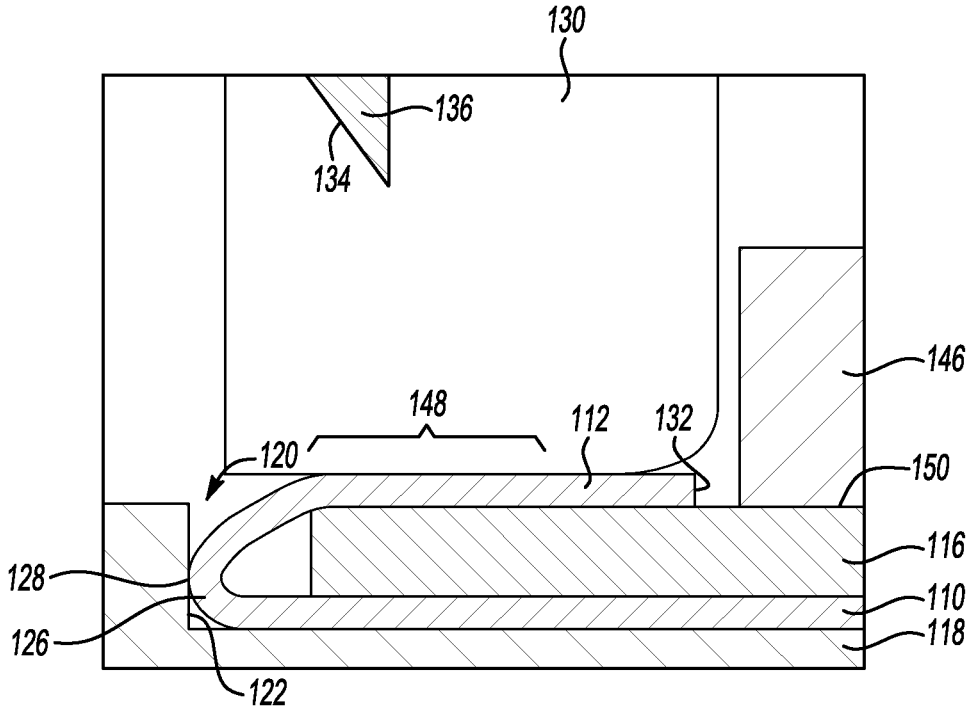
FIG. 12 is a diagrammatic cross-sectional view of the embodiment of FIG. 9 shown at the final stage in the hem forming process.

An intermediate portion 148 of the flange 112 is first formed into a convex outwardly facing shape, as shown in FIG. 10, because the distal end 132 of the flange 112 contacts the inwardly angled surface 134 of the stop 136. The intermediate portion 148 is formed against the upper surface 150 of the inner panel 116 to complete the hem forming process. During the hem forming process, the second hem tool 130 exerts a compressive force through the flange 112 forcing the base 126 of the flange 112 into engagement with the perimeter edge 122 of the cavity 120. In this way, a sharp edge is maintained at the outer edge 128 of the panel 110.

Figure 13:
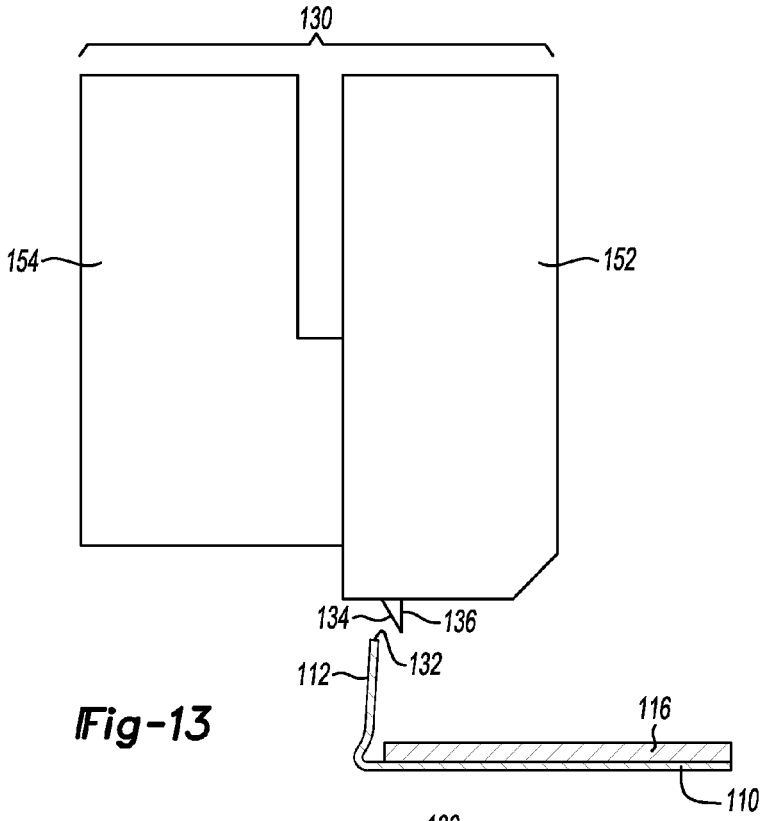
FIG. 13 is a diagrammatic side elevation view of the tool made according to the third embodiment shown in FIG. 9.
Figure 14:
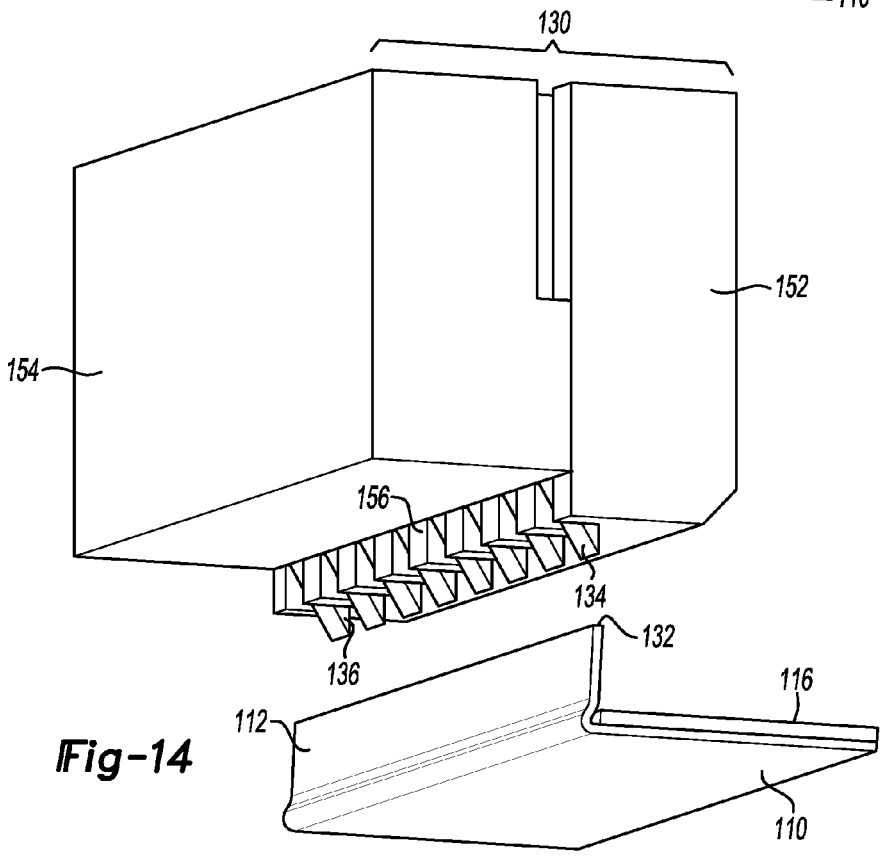
FIG. 14 is a diagrammatic exploded perspective view of the tool shown in FIG. 9 disposed above a flange of a panel that is in position to be hemmed over an inner panel.

Referring to FIGS. 13-16, the panel 110 is shown with the flange 112 extending upwardly and inwardly toward the inner panel 116. A distal end 132 of the flange 112 engages inwardly angled surface 134 of the stop 136. As shown in FIG. 13, the distal end is spaced from the inwardly angled surface 134 and is shown prior to the step illustrated by FIG. 9 wherein the second hem tool 130 has been moved downwardly to engage the distal end 132. The second hem tool 130 includes an inner portion 152 and an outer portion 154 that are moveable relative to each other to perform the operation described with references to FIGS. 9-12. A plurality of ribs 156 are formed on the inner portion 152 of the second hem tool 130. A plurality of grooves 160 are provided between the ribs 156 on the inner portion 152 of the second hem tool 130. A plurality of ribs 162 are also formed on the outer portion 154 of the second hem tool 130. The ribs 162 are spaced apart by grooves 164 defined by the outer portion 154 of the second hem tool 130. The ribs 156 and 162 are inter-engaged with the ribs 156 being received in the grooves 164 and the ribs 162 being received in the ribs 156, as shown in FIG. 14.

Figure 15:
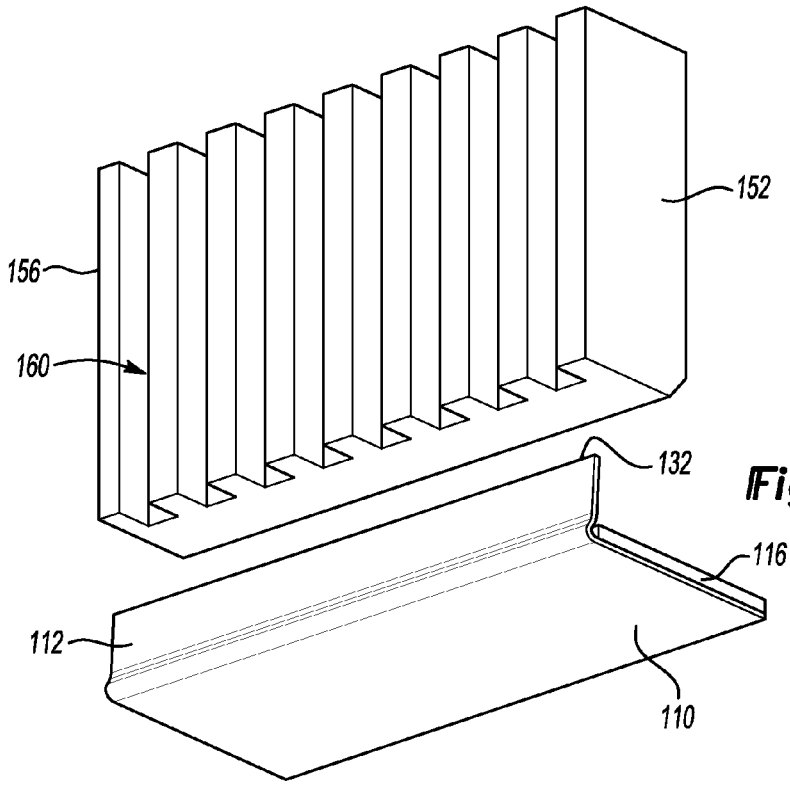
FIG. 15 is an exploded perspective view of one part of a hem forming tool disposed above a panel ready to be hemmed over an inner panel.
Figure 16:
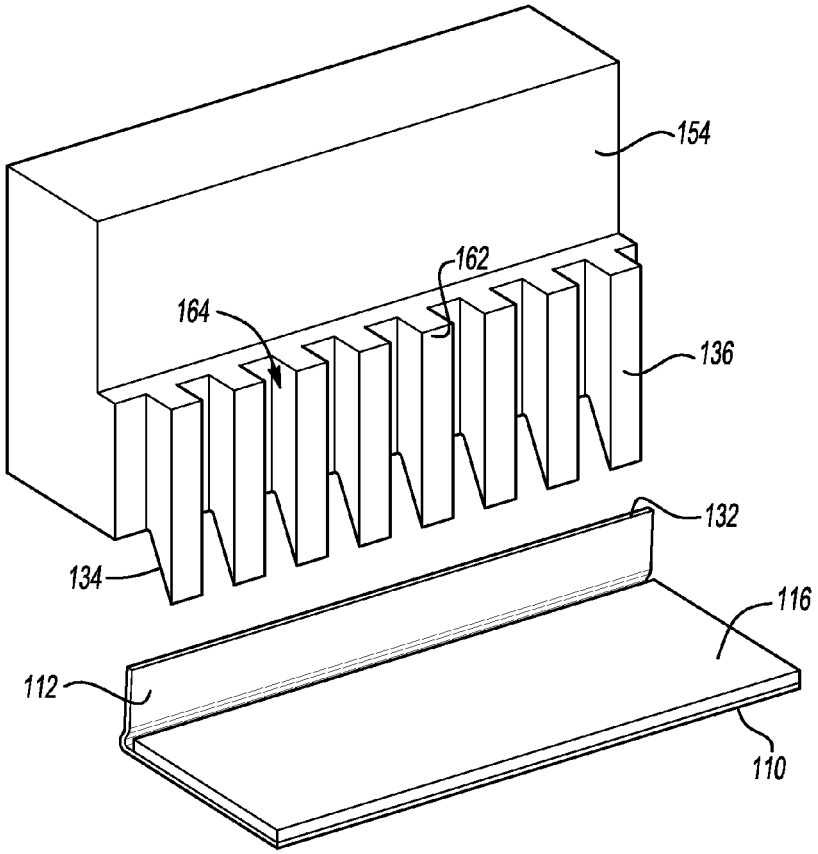
FIG. 16 is an exploded perspective view of a second part of the tool shown in FIG. 15 disposed above a panel ready to be hemmed over an inner panel.

Referring to FIG. 15, the inner portion 152 is shown in isolation to more clearly illustrate the relationship of the ribs 156 and the grooves 160. Referring to FIG. 16, the outer portion 154 of the second hem tool 130 shown in FIGS. 13 and 14 is shown in isolation to illustrate the relationship between ribs 162 and grooves 164. The ribs 162 terminate in the stops 136 upon which the inwardly angled surface 134 is provided, as previously described.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a hem on a sheet metal panel comprising:

placing the panel in a first part of a hemming tool, wherein the panel has a flange that extends inwardly from a body portion of the panel;

advancing a second part of the hemming tool toward the first part and engaging a distal end of the flange with a stop that prevents the distal end of the flange from moving inwardly and compressing the flange, wherein an intermediate portion of the flange between the body portion and the distal end is formed inwardly;

disengaging the stop from the distal end of the flange after a first portion of the flange is formed to extend parallel to the body; and forming a second portion of the flange that is contiguous with the distal end of the flange to extend parallel to the panel after the first portion of the flange is formed.

2. The method of claim 1 wherein the intermediate portion of the flange is formed into a concave cross-section in an outwardly facing direction as the intermediate portion is formed inwardly in the step of advancing the second part.

3. The method of claim 1 further comprising moving the stop inwardly as the second part of the hemming tool advances toward the first part.

4. The method of claim 1 wherein the second part of the hemming tool includes an inner portion and an outer portion that move independently, wherein the inner portion includes the stop, and wherein during the step of advancing the second part, the stop prevents the distal end of the flange from moving inwardly as the outer portion bends an intermediate portion of the flange inwardly of the distal end.

5. The method of claim 4 wherein the outer portion clamps the intermediate portion of the flange while the inner portion forms the distal end inwardly and into alignment with the intermediate portion of the flange.

6. The method of claim 1 wherein the stop is a block that has an inwardly angled surface, wherein the block is retracted into the second part of the hemming tool as the second part of the hemming tool moves toward the first part of the hemming tool.

7. The method of claim 6 wherein the second part of the hemming tool has an inner portion and an outer portion, the stop being provided on the outer portion, and wherein the inner portion advances towards the first part of the hemming tool while the outer portion remains stationary relative to the first part of the hemming tool.

8. A method of hemming a part comprising: moving an inner portion and an outer portion of a hemming tool independently;

engaging a distal end of a flange of a first panel with a stop on the inner portion;

forming an intermediate portion of the distal end to engage a second panel wherein the stop prevents the distal end of the flange from moving inwardly as the outer portion bends an intermediate portion of the flange inwardly of the distal end;

disengaging the stop from the flange after forming the intermediate portion of the flange to engage the second panel; and forming a distal portion of the flange including the distal end to engage the second panel after disengaging the stop.

9. The method of claim 8 wherein the stop prevents the distal end from moving inwardly while the intermediate portion is formed to engage the second panel.

10. The method of claim 8 wherein the distal portion of the flange is formed to extend parallel to the second panel after the stop is disengaged from the distal end.

11. The method of claim 8 wherein the intermediate portion of the flange is formed into a concave cross-section in an outwardly facing direction as the intermediate portion is formed inwardly during the step of forming the intermediate portion.

12. The method of claim 8 further comprising moving the stop inwardly during the step of forming the intermediate portion.

13. The method of claim 8 wherein the outer portion clamps the intermediate portion of the flange while the inner portion forms the distal end inwardly and into alignment with the intermediate portion of the flange.

* * * * *